United States Patent [19]

Kuck et al.

[11] 4,250,000

[45] Feb. 10, 1981

[54] ELECTROCHEMICAL PROCESS FOR METAL ALKOXIDES

[75] Inventors: Mark A. Kuck, Upper Montclair, N.J.; Gary K. Miller, Port Chester; Miguel Coll-Palagos, Rye, both of N.Y.

[73] Assignee: Stauffer Chemical Company, Westport, Conn.

[21] Appl. No.: 23,937

[22] Filed: Mar. 26, 1979

[51] Int. Cl.[3] ..... C25B 3/12

[52] U.S. Cl. ..... 204/59 QM

[58] Field of Search ..... 204/59 R, 59 QM, 72

[56] References Cited

U.S. PATENT DOCUMENTS

| | | | |
|---|---|---|---|
| 3,197,392 | 7/1965 | Silversmith et al. | 204/59 L |
| 3,730,857 | 5/1973 | Tripp | 204/59 R |
| 3,964,983 | 6/1976 | Eisenbach et al. | 204/59 L |
| 3,980,535 | 9/1976 | Knittel et al. | 204/59 R |

*Primary Examiner*—F. C. Edmundson

*Attorney, Agent, or Firm*—Henry Z. Friedlander

[57] ABSTRACT

Metal alkoxides, such as antimony glyoxide, are produced in the anolyte of a compartmented electrochemical cell, characterized by the seperation of the anolyte from the catholyte by an anion-exchange membrane. The anode comprises the sacrifical metal; the cathode is an indifferent material. Monohydric metal alkoxides also can be produced.

8 Claims, No Drawings

ELECTROCHEMICAL PROCESS FOR METAL ALKOXIDES

BACKGROUND OF THE INVENTION

1. Field of the Invention

This invention is an improved process for the production of metal alkoxides, more particularly antimony glyoxides. These compounds have utility as catalysts. They are especially useful as catalysts for the polymerization of glycols and diacids or their derivatives to make polyesters. Antimony glyoxides can be made by the reaction of antimony halides or oxides with ethylene glycol, propylene glycol, or their alkali metal glycolates (glyoxides). The straight chemical approach leads to the formation of unwanted by-products and impure antimony glyoxide which must be purified. More elegant is an electrochemical synthesis employing antimony anodes in a glycol medium whereby the major by-product is hydrogen, which does not contaminate the product.

2. Description of the Prior Art

The electrochemical preparation of metal organic compounds has been disclosed in U.S. Pat. No. 3,964,983 granted June 22, 1976 to Eisenbach et al. This disclosure includes a wide variety of active hydrogen compounds with a pk (negative logarithm of the acidity) from 5 to 20 and metals with a standard potential more positive than −1.66 volts. Furthermore it discloses and claims that water is sometimes a beneficial component of the electrolyte. "Diaphragms" are sometimes employed by Eisenbach et al, but are never described.

Production of monohydric alkoxides is disclosed in a method published in U.S. Pat. No. 3,730,857 granted May 1, 1973 to Tripp. This disclosure encompasses metals of Group IV or Va of the periodic table of the elements with atomic numbers from 14 to 82. No "diaphragms" or separators are mentioned in this patent. Ethylene glycol is characterized as "inert" by Tripp, even when present as 25 percent of the electrolyte. Only monohydric compounds are disclosed or claimed as being operative, and the examples disclose only preparation of ethoxides.

The use of ion-exchange membranes as separators in the electrochemical preparation of organometal compounds is disclosed in U.S. Pat. No. 3,197,392 granted July 27, 1965 to Silversmith and Sloan. This disclosure is limited to hydrocarbons as reagents for making organometals of the tetraethyl lead type. The patent teaches that anion-exchange membranes and cation-exchange membranes are interchangeable equivalents. No distinction is made by Silversmith et al between ion-permeable separators which are uncharged such as porous porcelain, asbestos, parchment, polyethylene, glass fiber paper, and the like, which allow ions to pass indiscriminately, and ion-exchange membranes which prevent the passage of some ions on a selective basis.

3. Objects of the Invention

The principal object of this invention is to provide an improved process to produce metal alkoxides, electrochemically, at an anode while limiting reduction to metal at the cathode, which may contaminate the desired metal alkoxide. Another object of this invention is to provide a process with improved electrolytic efficiency for the synthesis of metal alkoxides. An additional object of this invention is to improve the yield of the desired alkoxide by substantially reducing formation of colloidal metal. A further object of the invention is to obviate the formation of potentially explosive colloidal metal, particularly antimony. Still another object of this invention is to provide a process for electrochemical synthesis which operates for long periods of time without the formation of impeding precipitates. Other objects will be apparent to one skilled in the art from the description and examples which follow.

SUMMARY OF THE INVENTION

The invention is an improved electrochemical process for preparing metal alkoxides, characterized by the use of an anion-exchange membrane as an electrochemical separator, in anhydrous media. The metal from which the alkoxide is to be made is used as a sacrificial anode.

Anhydrous glycol is the preferred alcoholic medium in which an electrolyte is dissolved. The anion-exchange medium restricts the metallic cations formed at the anode to the anolyte compartment. Since transport of metallic cations through the ion-selective separator is impeded, the amount of colloidal metal formed at the cathode by reduction is decreased. The glycolate anions formed at the cathode, however, can pass through the anion-exchange membrane to the anolyte, where the metal glyoxide is formed. Electrolytic and chemical yields both are increased in the process of the invention, as is the purity of the product. The process is particularly useful for preparing antimony ethyleneglyoxide.

Anhydrous monohydric alcohols can also be employed to prepare alkoxides by this process.

DESCRIPTION OF THE INVENTION

Laboratory practice of electrochemistry is over 150 years old. In the field of inorganic chemistry it has been commercialized for over a century. Organic electrochemistry is over 75 years old, but only in isolated instances has electrochemistry been the art of choice for synthesizing organic compounds, particularly on a commercial scale.

The usual chemical route for the preparation of metal alkoxides depends on the reactivity of the metal. Highly electropositive metals such as the alkali metals (Li, Na, K, etc.), alkaline earth metals (Ca, Mg, Sr, etc.), and aluminum react directly with alcohols to form alkoxides. Less electropositive metals must be reacted to form more active compounds, which in turn react with alcohols to form alkoxides. Examples are metal hydrides or alkyls (e.g. Zn, Hg, Cd). Another approach is to form a sodium or potassium alkoxide from the alcohol and then react this forerunning alkoxide with an anhydrous metal chloride (e.g. Ti, Zn, Ge, Sn, Pb the iodide, Cr, Sb, Mn and U). For the less reactive metals of groups IV and V of the periodic table of the elements the chemical route is expensive because costly derivatives (e.g. hydrides, alkyls, halides) must be prepared. The halides, metal halides, or ammonium chloride produced after neutralization have little value and present a disposal problem.

In view of the difficulties and costs associated with the chemical processes of the prior art, an electrochemical route is highly desirable for producing the metal glyoxides of metals not reactive enough to interact directly with glycols. In an electrochemical cell when the anode is constructed of the desired metal, it is consumed to produce soluble cations. At an indifferent cathode such as mild steel, aluminum, or carbon the glycol becomes the glycolate anion. When the negatively charged glycolate anions migrate to the positive anode, they encounter metallic cations, and the desired glyoxide is formed. In the ordinary electrochemical cell of the prior art metal cations can migrate to the cathode, where they are reduced to elemental metal, a contaminant for the alkoxide. Often procedures of the prior art lead to producing more metal than alkoxide.

Prior to the instant invention intercompartmental diffusion was a major problem. In the procedures of the prior art metal ions, formed in the anolyte from the sacrificial anode, could migrate to the cathode where they could be reduced forming a precipitate of colloidal metal. This colloidal metal contaminated the metal alkoxide or glyoxide. Furthermore, the production of the unwanted metal contaminant was both a chemical waste of scarce and expensive high-purity metallic anodes as well as representing costly electrical losses.

Some workers have employed a porous "diaphragm" to cut down diffusion. A diaphragm is nonselective, however. It impedes the diffusion of all ions in solution in part. Its main function is to prevent the diffusion of large solid particles once they have formed. A diaphragm does not prevent the formation of metallic contaminant, or metallic product, in a cell intended for the production of metallic alkoxides.

A "membrane" is defined as a selective interface, which differentiates the transport of entities in contact with it ("Membranes", Encyclopedia of Polymer Science, Vol. 8, pp 620–638, John Wiley Co., New York, 1968). Anion-exchange membranes allow anions to pass in an electric field, but electrolytically repulse cations. Cation-exchange membranes allow cations to pass, but reject anions. Thus, a membrane in contradistinction to a diaphragm is a selective separator in an electrochemical cell.

The imposition of an anion-exchange membrane between the anolyte and catholyte of an electrochemical cell for the production of metallic alkoxides and glyoxides (glycolates) is a critical feature of the process of this invention. Such a selective separator restricts the metal cation to the anolyte where it was generated preventing metal from being formed at the cathode. By definition, the anion-exchange separating membrane allows the glyoxide anion generated at the cathode to migrate to the anode under the force field of the electrochemical cell. The improvement of the process of this invention can be characterized as reducing the transport number of the metal cation toward zero and raising the transport number of the alkoxide or glyoxide anion toward one. In the anolyte the metal cation and glyoxide or alkoxide anion join to produce the metal glyoxide (glycolate) or alkoxide (alcoholate) by the process of this invention.

All metals may be arranged in an electrochemical series of activity from lithium, the most active metal chemically, at plus 3.05 volts at the top to gold, the least active metal chemically, at minus 1.68 volts at the bottom of the series. This invention becomes particularly advantageous for making metallic alkoxides generally and glyoxides specifically at that point in the electrochemical series where antimony is found at minus 0.21 volts and below. Proceeding down the series from antimony other preferred anodes are bismuth, copper, silver, and gold.

There are two means for providing the metallic cations, e.g. antimony, for making the alkoxides. Firstly, one may add a metallic salt soluble in the glycol or alcohol to the electrolyte and employ an indifferent anode such as carbon. The preferred method, however, is to employ an anode made from the metal whose alkoxide is being produced. Since such an anode loses weight as the synthesis progresses, it is termed a "sacrificial" anode. In order to agitate the electrolyte and to lessen the buildup of deposits of product on the anode, it may be rotated.

At the cathode, which can be of carbon, aluminum, steel, or any other benign conducting material, the glycol of the electrolyte is reduced by the current of electrons coming from the anode via the direct current power supply to provide the glyoxide ions.

Although ion-exchange membranes have been known for over 45 years (Zhukov et al, USSR Author's Certificate No. 33,464 granted Nov. 30, 1933), until the instant invention no one had used them before in a process for the production of metal glyoxides.

Early anion-exchange membranes were made by impregnating cellulosics with positively charged polymers such as gelatin. Modern anion-exchange membranes are ammonium salt derivatives of polystyrene crosslinked by divinylbenzene and formed into sheets by various processes. Anion-exchange membranes which can be used in the process of this invention are commercially available from AMF Inc., White Plains, New York; Asahi Chemical Industry, Tokyo, Japan; Asahi Glass Co., Yokohama, Japan; Ionics Inc., Watertown, Mass; Ritter-Pfaudler Corp., Rochester, New York; Permutit Ltd., London, England; Toyo Soda, Tokyo, Japan; and others.

The ability of an ion-exchange membrane to pass ions of one charge and reject ions of the opposite charge in an electric field is termed its permselectivity. For the practice of the process of this invention the permselectivity should be as high as possible, more preferably over 95 percent, preferably over 90 percent, but at least 70 percent.

The area-resistance of the anion-exchange membrane should be as low as possible more preferably below 10 ohm-cm$^2$, preferably below 20 ohm-cm$^2$, and less preferably below 40 ohm-cm$^2$.

In order to function as a discriminating barrier between cations (electrolytically repulsed) and anions, the anion-exchange membrane of this invention must have a sufficiently high ion-exchange capacity, more preferably greater than 2.0 meq/g dry weight, preferably greater than 1.5 meq/g, but at least 0.7 meq/g.

The source of direct electric current can be a direct current battery or rectified alternating current. From about 5 to about 80 volts can be employed, preferably about 10 to about 25 volts. The voltage employed depends on the cell design and the system being electrolyzed.

The electrolyte can be any salt which is soluble in the alcohol being used, anhydrous, and unreactive at both the cathode and anode being employed. Tetramethylammonium chloride is a suitable example as is lithium perchlorate (with caution) or tetrabutylammonium fluoborate. The concentration of electrolyte can be varied from about $0.5\times10^{-4}$ to about $10^{-2}$ M. The range is not critical to the synthesis, but determines in part the current density. The current density is also dependent on the voltage and area of the electrodes.

To avoid formation of metal oxides, which can contaminate the metal alkoxides produced, one must be careful to exclude water both from the medium and the atmosphere above the cell. Anhydrous electrolyte salt, anhydrous alcohol, and anhydrous inert diluent, if any be employed (e.g. acetone), are required. On a small scale drying tubes may be used to treat the air over the cell, or a blanket of dry nitrogen or dry compressed air may be swept through the cell. An exit port must be available for the hydrogen generated at the cathode to leave the cell, and provision must be made to keep water from entering at that point.

The temperature of the electrolysis is not critical; it can be carried out at any convenient temperature. The bottom of the temperature range is limited by the increasing viscosity of the glycol as the temperature decreases. This temperature effect can be compensated for by adding a more fluid, inert diluent such as acetone, or butanone to the electrolyte. As a practical matter, there is no advantage, ordinarily, in running the electrolysis below minus 20° C. Temperatures above about 0° C. are preferred and above about 20° C. more preferred. The upper limit of temperature is determined by the thermal and chemical stability of the ion-exchange membrane used. For most commercial anion-exchange materials about 65° to about 70° C. is the highest continuous operating point without mechanical weakening of the plastic/polystyrene matrix itself or thermal degradation of the trimethylammonium salt which usually constitutes the anion-exchange moiety. Most ion-exchange membranes are derivatives of polystyrene grafted to or blended with a hydrocarbon or fluorocarbon film-forming polymer. Cation-exchange products based on sulfonic acid salts are more thermally stable than anion-exchange products based on ammonium salts. The film-forming polymer makes some contribution to thermal stability also. The skived, cross-linked products of Asahi Chemical Industry, tradenamed "Aciplex", the AMF Inc. fluorocarbon based membranes, tradenamed "AMFion A-310", and the Permutit Ltd. product tradenamed "Permaplex A-20", along with Ionics Co. "Nepton ARIII" have superior thermal resistance, but are still limited to operation at about 80° C. because of chemical degradation. The preferred upper limit for long useful life of the membrane is about 55° C. with about 45° C. more preferred. The most preferred temperature range for the process of the present invention is about 20° to 45° C.

On a small experimental scale agitation can be furnished by rotating both electrodes at about 30 to 150 rpm. For larger equipment producing kilogram amounts and above, the electrolysis is improved by circulating the electrolytes by means of a pump. Recirculation of the electrolyte, especially the anolyte, increases the electrochemical efficiency of the electrolysis by inhibiting the adsorption of fine particles of the metal glyoxide produced onto the anion-exchange membrane or the anode. The production of hydrogen at the cathode helps circulation of the catholyte.

The rate of electrolysis depends on the size of the cell, its electrical resistance, and the direct current voltage available. There is no reason why a typical electrolytic cell cannot be run indefinitely as long as the anodes are periodically replaced.

The following examples illustrate the utility and best mode of this invention, but should not be interpreted as limiting its scope. Propylene glycol or any anhydrous glycol may be substituted for ethylene glycol as the medium/reagent. Anhydrous monohydric alcohols may also be employed. Any metal between −0.20 and −1.68 volts on the electromotive series may be used in place of antimony, especially useful are copper, bismuth, silver, gold and palladium.

COMPARATIVE EXAMPLE 1

This example illustrates the results obtained by electrolysis without an anion-exchange membrane. An antimony anode 2 cm by 1 cm by 6 cm was made by melting 99.9% Sb (K and K, Inc., Plainview, N. Y.) at 650° C. and pouring into a ceramic boat. It was mounted within a mild steel, cylindrical cathode 5 cm in diameter and rotated at 60 rpm. Under nitrogen 400 ml. of ethylene glycol, dried over Union Carbide Corp. 3A molecular sieve was added to the 600-ml pyrex, cylindrical beaker without any diaphragm or membrane. To the medium was added 0.5 g. lithium chloride and 5.9 g. lithium perchlorate. The electrolysis was carried out for 17 hours at 35° C., whereupon 1.5 g. of fine, dark solid was obtained. By elemental analysis this sample was found to be 98 percent metallic antimony. No solid antimony glyoxide was found in the electrolyte solution.

The formation of metallic antimony when antimony glyoxide is desired can be a hazardous phenomenon. The following is a quotation at page 91, "Antimony" from "Chemical Periodicity" by R. T. Sanderson, Reinhold, New York, 1960. "A vitreous form called "explosive antimony", which changes almost explosively to the crystalline form, sometimes results from electrolysis of antimony solutions".

COMPARATIVE EXAMPLE 2

Example 2 illustrates how a different type of cell, again without a diaphragm or membrane, produces colloidal antimony metal when antimony glyoxide is the synthetic goal.

A cylindrical glass jar five cm. in diameter formed the lower segment of this cell. This lower portion was water jacketed for temperature control and was equipped with a magnetic stirring bar, a centrally positioned, static rectangular antimony anode 1 by 2 by 0.1 cm and a cylindrical 5 cm long cathode 4 cm in diameter fitted with a lead wire to the outside. Connected by an O-ring joint, six cm. in diameter was a hemispherical head with a central lead wire for the anode and small tangential ports for the thermometer, dried nitrogen inlet, and reflux condensor through which the hydrogen generated could exit.

Into this cell was placed 200 ml. dried ethylene glycol, 0.33 g. lithium chloride, and 5.5 g. lithium perchlorate. For 16 hours 9.5 volts was impressed on the cell. The current flow was 0.2a. The electrolyte was stirred at 60 rpm. The temperature was maintained at 25° to 35° C. At the end of the electrolysis 0.5 g of fine, dark powder was separated, which upon elemental analysis was shown to be 98 percent antimony. No solid antimony glyoxide was found in the electrolyte. The colloidal antimony besides being wasteful is also potentially hazardous.

COMPARATIVE EXAMPLE 3

In the same equipment and employing the same procedure as Example 2 another electrolyte was tried, again failing to yield the desired product.

Into a 200-ml dried ethylene glycol sample, as in Example 2, was added 4.0 g dry tetramethylammonium chloride as the electrolyte. At 20 volts, 0.4–0.7a flowed for 18 hours at 25°–30° C. yielding 0.6 g colloidal metallic antimony by elemental analysis. No solid antimony glycolate was found in the liquid medium.

EXAMPLE 4

This example illustrates one embodiment for producing antimony glyoxide.

An "H"-shaped electrolytic cell was made of 5-cm diameter vertical and 2.5-cm diameter horizontal glass tubes. The antimony anode was 1-cm thick, 10 cm long by 1-cm wide. It was placed 3.5 cm from an aluminum sheet cathode sized 1 cm by 10 cm. In the horizontal member of the "H" cell was placed an electrolytic, separating, anion-exchange membrane comprising the trimethylammonium salt of cross-linked polystyrene designated A103QZL-219 by the Ionics Co. In the 200 ml of dried ethylene glycol was dissolved 4.0 g of dry tetramethylammonium chloride. The electrolysis was run at 24 volts and 0.04 amperes for 82 hours, whereupon 4.9 g of antimony glyoxide was separated by filtration and washed with acetone. The antimony glyoxide product gave an analysis of 59.5 percent antimony. Theoretical antimony content is 57.5 percent. Although this current density is low, the current efficiency was calculated at 58 percent. The product bore an off-white color.

EXAMPLE 5

Example 5 illustrates the best mode of practicing the instant invention insofar as laboratory equipment is concerned. Inline and dual, cylindrical glass flange, O-ring joints 10 cm in diameter were fitted with magnetic stirring bars, dry nitrogen inlets, circular slab electrodes 9.2 cm in diameter, plus a stopcock on each side of the separator. In the center was placed a separator of the polystyrene type A103 QZL-219 anion-exchange membrane from the Ionics Company of Example 4. The antimony anode and aluminum cathode were each placed 4.5 mm from this membrane. In each cylindrical side was put the same electrolyte: 250 ml of dried ethylene glycol containing 5.0 g of dry tetramethylammonium chloride. The electrolysis was run for 88 hours at 23 volts and 0.22 amperes to yield 28.2 g of off-white antimony glyoxide analyzing 54.3 percent antimony (calculated 57.5 percent). Weight loss of the antimony electrode was 22.8 g. The chemical efficiency was 71.1 percent. All of the product was isolated from the anolyte.

COMPARATIVE EXAMPLE 6

Example 6 is an experimental control illustrating the preferred electrolytic cell fitted, however, with the type of separator employed before the instant invention and the inadequate results achieved.

The linear 0-ring cell of Example 5 was fitted with No. 50 Whatman cellulosic filter paper as an electrolytic separator. The same electrolyte as in Examples 4 and 5 was used with 8 volts impressed giving a much higher current of 0.6 amperes, because of the lower electrolytic resistance of the filter paper compared to the anion-exchange membrane. After 17 hours at 35° C., there was a weight loss of 12.6 g from the antimony anode, but no antimony glyoxide precipitated from the anolyte. There was found, however, colloidal metallic antimony in the catholyte formed by cathodic reduction of antimony cation which had migrated through the nonrepelling filter paper as separator.

COMPARATIVE EXAMPLE 7

This example illustrates the use of another type of non-selective diaphragm.

In the same electrolytic cell as in Example 5 with the same electrodes and the same electrolyte 22 volts was impressed across the cell fitted with a "fine" porosity glass frit from the Ace Glass Company. The current flow was an unacceptable 0.02 amperes. This separator was replaced by a "coarse" porosity glass frit of the Ace Glass Company leading to a current flow of 0.11 to 0.31 amperes for 42 hours at 26° C. No solid antimony glyoxide was found in the anolyte, but 0.43 g of metallic antimony was isolated from the catholyte.

COMPARATIVE EXAMPLE 8

This example further illustrates the use of another type of electrolytic separator prior to the instant invention. In the same type of cell with the same electrolyte and the same electrodes as in Example 5 a Teflon fabric reinforced fluorocarbon plastic separator Nafion 701 from the duPont Company (Wilmington, Delaware), was inserted as the separator. This membrane is often used as an electrolytic separator in the chlorine/caustic industry. With 18 volts impressed 0.28 amperes initially flowed, but within ten minutes the current was an unacceptable 0.15 amperes. After 69 hours at 40° C. no solid antimony glyoxide precipitated in the anolyte, but 1.2 g of antimony metal was found in the catholyte.

At this point a clear microporous fluorocarbon variant, Nafion 120, was inserted as a separator, leading to zero current flow with 25 volts impressed.

EXAMPLE 9

The method, equipment, electrodes, and electrolyte of Example 5 were repeated, again with an Ionics Company A103QZL-219 anion-exchange membrane as the separator. Three batches were run with successively higher voltages of 11, 16 and 22 volts for 28, 24 and 20 hours respectively. After each batch the anolyte slurry of precipitated product was mixed with 100 ml. acetone to improve filterability, filtered to separate the antimony glyoxide, heated to remove the acetone, and replaced in the anodic chamber of the cell. By this means successively 16.8, 13.5, and 11.1 g of product were isolated analyzed at 65.4, 68.2 and 64.7 percent antimony, showing some hydrolysis during the three-batch process (calculated antimony for the glyoxide 57.5 percent).

Thereafter a fourth batch was run for 45 hours at 17 volts and 0.46 to 0.15 amperes yielding 23.7 g. of antimony glyoxide isolated from the anolyte with an antimony analysis of 63.2 percent.

EXAMPLE 10

This example illustrates the use of a laboratory apparatus for a long time to produce a larger size sample of the desired metal glyoxide.

In the same apparatus of Example 5 fitted with an Ionics Company A103QZL-219 anion-exchange membrane, 250 ml. of dried ethylene glycol containing 5.0 g. of dry tetramethylammonium chloride was placed in each compartment. The anode was a circular slab of 99.99 percent antimony 9 cm. in diameter, 0.7 cm. thick immersed in the solution to the depth of 7.0 cm. The cathode was of aluminum sheet 9 cm. in diameter, two mm. thick. Current was impressed for 25 days at 21 volts; the temperature varied between 30° to 40° C. From the anolyte a total of 130 g. of antimony glyoxide was isolated, which by elemental analysis proved to be 57.2 percent antimony. No antimony metal was observed to form within the cathodic side of the cell.

The foregoing examples illustrate the utility and best mode of practicing the instant invention. The scope of legal protection sought for this invention is set forth in the claims.

We claim:

1. In a process for the electrochemical preparation of metal alkoxides by passing a direct current between an anode of a metal selected from the group consisting of metals which have a standard electrode potential on the electromotive series between about minus 0.20 volts and about minus 1.68 volts and an indifferent cathode through an anhydrous electrolyte containing an alcohol having one or two hydroxy groups and a conducting salt the improvement which comprises utilizing as an electrolytic separator between anolyte and catholyte an anion-exchange membrane having a permselectivity for anions of at least 70 percent whereby the metal alkoxide is formed in the anolyte.

2. The process of claim 1 wherein the metal is selected from the group consisting of copper, silver, gold, bismuth and antimony.

3. The process of claim 2 wherein the metal is antimony.

4. The process of claim 1 wherein the membrane has a permselectivity for anions of at least about 85 percent.

5. The process of claim 1 wherein the alcohol is a glycol.

6. The process of claim 1 wherein the alcohol is ethylene glycol.

7. The process of claim 1 wherein the alcohol is propylene glycol.

8. The process of claim 1 wherein the metal is antimony and the alcohol is ethylene glycol.

* * * * *